US005803274A

United States Patent [19]

Scheveloff

[11] Patent Number: 5,803,274

[45] Date of Patent: Sep. 8, 1998

[54] ARTICLE DISPLAY SYSTEM

[76] Inventor: Saul Scheveloff, 1466 First Ave., Suite 2B, New York, N.Y. 10021

[21] Appl. No.: 786,874

[22] Filed: Jan. 23, 1997

[51] Int. Cl.[6] ..... A47F 5/08

[52] U.S. Cl. ..... 211/87; 211/103; 211/90.02; 52/36.6; 248/220.43; 248/243; 108/108

[58] Field of Search ..... 211/103, 50.01, 211/87.01, 50.02, 50.04; 108/106, 107, 108, 152; 52/36.4, 36.5, 36.1, 506.01; 248/220.31, 220.41, 220.43, 247, 243, 248; 160/135, 351

[56] References Cited

U.S. PATENT DOCUMENTS

| | | | |
|---|---|---|---|
| 2,355,651 | 8/1944 | Hormes | 248/243 |
| 2,998,107 | 8/1961 | Zimmerla | 108/108 X |
| 3,193,885 | 7/1965 | Gartner et al. | 108/108 X |
| 3,290,846 | 12/1966 | Mader et al. | 211/90.04 X |
| 3,394,507 | 7/1968 | Doke . | |
| 3,482,706 | 12/1969 | Stewart | 211/87.01 X |
| 3,516,552 | 6/1970 | Salava . | |
| 3,685,234 | 8/1972 | Nelsson | 108/108 X |
| 3,714,748 | 2/1973 | Costruba | 108/108 X |
| 3,826,207 | 7/1974 | Sutherlan | 211/90.01 X |
| 4,370,838 | 2/1983 | Vermillion | 52/36.6 |
| 4,731,960 | 3/1988 | Sease | 52/36.6 |
| 4,891,897 | 1/1990 | Gieske et al. . | |
| 5,138,803 | 8/1992 | Grossen . | |

FOREIGN PATENT DOCUMENTS

| | | | |
|---|---|---|---|
| 2331303 | 6/1977 | France | 52/36.3 |

*Primary Examiner*—Peter M. Cuomo
*Assistant Examiner*—Janet M. Wilkens
*Attorney, Agent, or Firm*—Charles W. Chandler

[57] ABSTRACT

An article display system includes an upright support panel having a series of vertical grooves in its front face that serve to mount a number of bracket support fixtures flush with the panel front face. Each fixture is adapted to support an article-support bracket located in front of the support panel. An ornamental covering is provided on the panel front face to conceal the bracket support fixture.

12 Claims, 2 Drawing Sheets

ARTICLE DISPLAY SYSTEM

BACKGROUND AND SUMMARY OF THE INVENTION

This invention relates to an article display system, and particularly to a display system used in retail stores for displaying articles of clothing on sale in the store, e.g. sweaters, shirts, dresses, and pants.

Prior to this disclosure, various article display systems of a somewhat similar nature have been devised and used commercially.

U.S. Pat. No. 3,516,552, issued to Otto G. Salava, discloses an article support system comprising a vertical panel having a series of regularly spaced perforations designed to receive article-suspension fixtures. Each fixture has an L-shaped hook structure that can be inserted into one of the perforations to mount the fixture on the panel.

U.S. Pat. No. 3,394,507, issued to Jack Doke, discloses a shelf-support system that includes a series of upright metal studs mounted on a building wall to form mounting surfaces for individual panels spanning the studs. A row of slots therein can be used to support shelf brackets.

U.S. Pat. No. 5,138,803, issued to John F. Grossen, shows an upright display panel having a number of T cross-section slots running horizontal along the panel front face. Each slot has a resilient liner that can be inserted into the slot by compressing the liner and moving it through the narrow neck opening of the slot. The liners improve the appearance of the panel by hiding the mounting fasteners for the panel.

U.S. Pat. No. 4,891,897, issued to Detlef J. Gieske and David B. Kawchak shows a display panel formed by a number of horizontal slots fastened to cleats or other support structure by screws at the slot edges. Horizontal slots are formed along the slot edges for supporting various brackets or components, e.g. a shelf, a hook, or a sign.

The present invention relates to a simplified article display system that comprises one or more upright support panels mountable on a store building wall to display articles for sale in the store. In the preferred practice, the panels are arranged in contiguous relation so as to occupy one entire wall of the store or room. Each panel has a number of concealed bracket supports at regularly spaced points along the panel front surface. Article-support brackets can be mounted on the concealed supports for supporting the articles to be displayed. Such articles can be shirts, sweaters, pants, dresses or shoes in the case of a clothing store.

The nature of the article-support brackets can, of course, be varied depending on the type of article to be displayed. A hardware store might require differently constructed brackets than a clothing store. The present invention is concerned primarily with the mechanisms on the display panel for mounting the article-support brackets, not on the particular brackets used.

Specific features of the invention will be apparent from the attached drawings and description of a particular embodiment of the invention.

DESCRIPTION OF THE DRAWINGS

The description refers to the accompanying drawings in which like reference characters refer to like parts throughout the several views, and in which: characters refer to like parts throughout the several views, and in which.

DESCRIPTION OF A PREFERRED EMBODIMENT OF THE INVENTION

Figure 2:
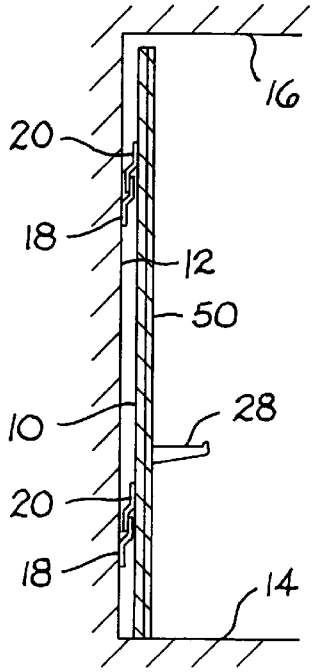
FIG. 2 is a sectional view taken on line 2—2 in FIG. 1.
Figure 1:
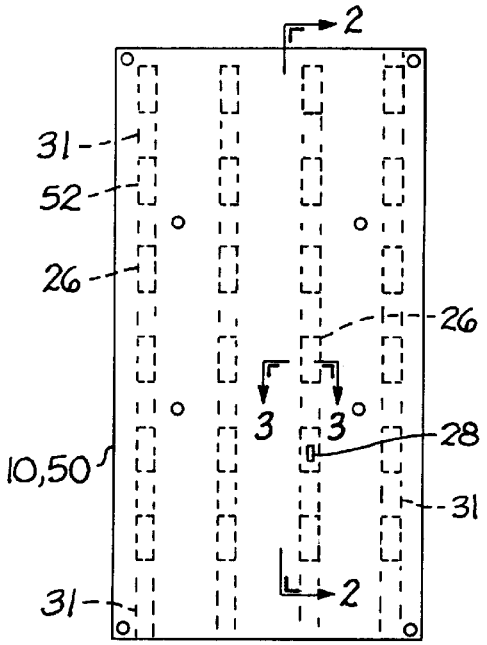
FIG. 1 is a front view of an article display panel and ornamental covering construct according to the invention.

FIGS. 1 and 2 show an article display system that includes an upright support panel 10 mounted on a building wall 12 to extend from floor 14 substantially to ceiling 16. Typically, panel 10 can have a height of about 8', a width of about 4', and a thickness of about ¾". The panel can be formed of plywood or other suitable material having a thickness approaching ¾".

Various methods and mechanisms can be used to releasably attach support panel 10 to building wall 12. As shown in FIG. 2, the attachment mechanism comprises two upwardly facing hook structures 18 on wall 12, and two downwardly facing hook structures 20 on the rear face of panel 10. In practice, there will be four sets of hook structures, one near each corner of the panel.

The drawings show a single article support panel. However, in practice a plurality of similarly constructed panels can be arrangement in contiguous fashion along one wall of a building to provide a continuous article-display surface of any desired length.

Figure 4:
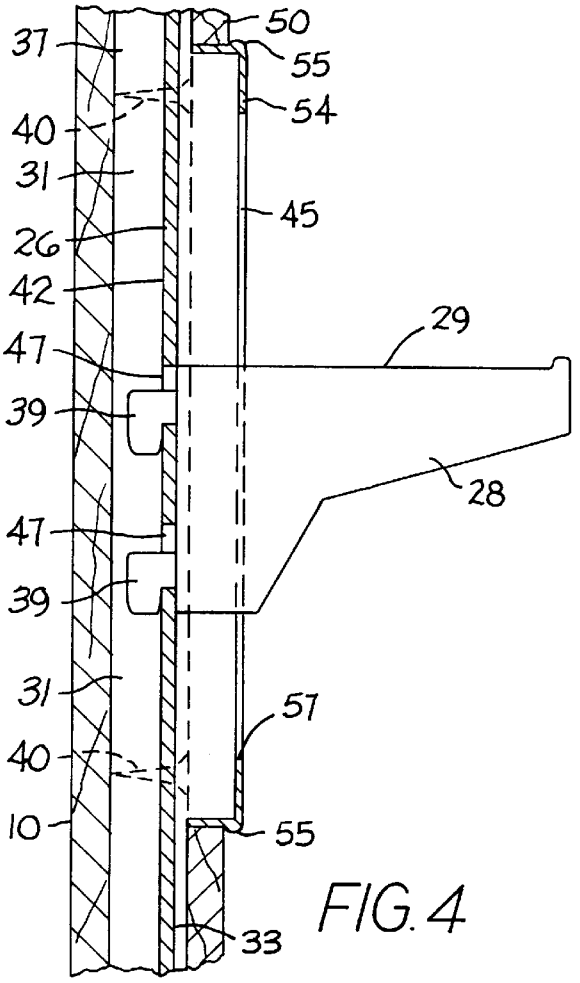
FIG. 4 is a fragmentary sectional view taken on line 4—4 in FIG. 3.

As shown in FIG. 1, the display panel has four vertical rows of bracket fixtures or supports 26; there are six bracket supports in each row, providing a total of twenty-four bracket support fixtures on the panel. Each bracket support fixture 26 can be used to mount an article support bracket 28 located on the front face of the display panel. FIG. 1 shows one such support bracket 28, with only the edge of the bracket being visible. FIG. 4 shows the same bracket in side elevation.

Supports 26 are identical to each other. However, the article support brackets 28 can have various configurations, depending on the nature of the article to be displayed. As shown in FIG. 4, article support bracket 28 is configured as a forwardly extending flat plate member having an upper edge 29 adapted to suspend one or more coat hangers, not shown. Dresses, coats, shirts and sweaters can be hung on the coat hangers for display in front of the display panel or a shelf can be mounted between two brackets.

Each bracket support fixture 26 is mounted in a vertical groove 31 in the front face of support panel 10. In the arrangement depicted in FIG. 1, panel 10 has four vertical grooves 31. Each groove serves as a mounting mechanism for six bracket support fixtures 26. Each groove has a T cross-section, that comprises a relatively wide shallow section 33 in the front face 35 of the panel, and a relatively narrow deep section 37 extending rearwardly from shallow section 33.

Figure 3:
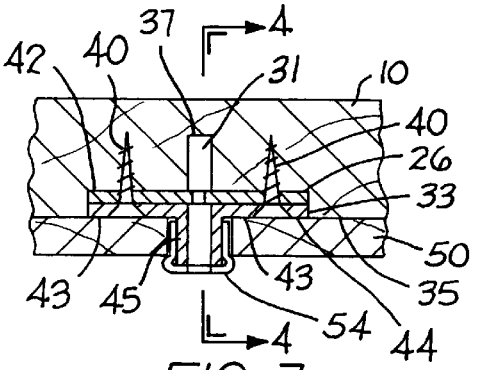
FIG. 3 is a fragmentary enlarged sectional view taken on line 3—3 in FIG. 1.

The T cross-sectional shape of groove 31 is shown in FIG. 3. The bracket support fixture 26 occupies the wide shallow section of groove 31. The narrow deep section 37 of the groove provides an accommodation space for hooks 39 that extend from article support brackets 28. The T cross-sectional grooves 31 may be formed by a milling (cutting) operation on the plywood panel 10 prior to installation of the support fixtures 26. Each fixture can be secured to panel 10 by means of screws 40 located at spaced points along the fixture.

Each fixture 26 is preferably formed of steel plate for strength, although other materials (e.g. rigid plastic) could conceivably be used. As shown in FIG. 3, the fixture has a width that corresponds to the width of groove section 33, whereby each fixture acts to reinforce the panel against bending or cracking. The T cross-sectioned grooves 31 weaken the plywood panel, whereas fixtures 26 reinforce and restore the panel to its original strength.

Each fixture 26 comprises a flat rectangular back plate 42 positioned flatwise against the rear surface of groove section 33, and two angle members 43 welded to the front face of plate 42. As shown in FIG. 4, each fixture 26 extends the full height of panel 10.

Each angle member 43 has one leg 44 secured to plate 42 and a second leg 45 extending forwardly from plate 42. In the preferred practice of the invention, angle members 43 are welded to plate 42, to provide a relatively strong support fixture 26. Legs 45 form a vertical channel that is adapted to receive the plate (bracket) 28, as shown in FIG. 4. The spacing of legs 45,45 corresponds to the transverse thickness of the bracket 28 material shown in FIG. 4. The spacing of legs 45,45 corresponds to the transverse thickness of plate 28, whereby the bracket plate is reinforced against lateral movement. Typically the leg 45 spacing (and plate 28 thickness) is about 3/16".

Back plate 42 has 2" vertical slots 47 on 1" centers, adapted to receive hooks 39 that extend from the rear edge of bracket 28, whereby the bracket can be mounted in fixture 26 as shown in FIG. 4. Each slot 47 has a width that is less than the leg 45 spacing, such that the rear edge of bracket 28 has firm contact with the front face of plate 42.

Hooks 39 are formed out of plate material having the same thickness as the slot 47 width.

In an alternative arrangement, fixture 26 can be formed as a one piece extrusion having the cross-sectional configuration depicted in FIG. 3. In either case the front surface of fixture 26 is flush with the front face of panel 10, as shown in FIG. 3.

In the preferred practice of the invention, the front face of panel 10 is concealed by an ornamental covering 50. This covering may be a flexible decorative sheet or a decorative panel having a thickness of about 3/8" or less, since the decorative panel (or sheet) is non-load bearing. The drawings show the decorative covering as a panel. Ornamental panel 50 can be secured to the load-bearing panel 10 by various mechanisms, such as screws, clips, contact adhesive, or hook and loop fastener patches. Preferably the ornamental panel is detachably fastened to panel 10 to permit easy replacement of one ornamental panel with another differently colored panel, as may be necessary to change the nature of the display.

Figure 5:
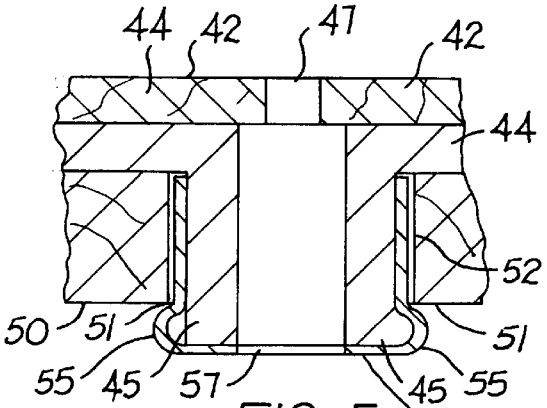
FIG. 5 is an enlarged fragmentary view taken in the same direction as FIG. 3, but show g some features in greater detail.

Slot-like perforations 52 are formed in panel 50 to accommodate bracket support fixtures 26, whereby walls 45 of the fixtures project forwardly through the plane of panel 50, as shown best in FIG. 5.

Since it is difficult to simultaneously align all of the perforations 52 with the projecting portions of fixtures 26, the perforations are made slightly oversize relative to the projecting walls 45 of the fixtures. In order to conceal the joint 51 between each perforation 52 and the fixture walls 45 an ornamental cap 54 is fitted onto walls 45. This cap has a peripheral bead 55 running along joint 51, whereby the joint is effectively concealed from view. Cap 54 can be of any desired material, e.g. metal or plastic. Preferably the cap is colored to harmonize with the associated ornamental panel 50. Each cap 54 is formed with an opening 57 of sufficient size to enable bracket 28 to be inserted or removed from fixture 26 without first removing the cap.

Article support brackets 28 can be selectively positioned in any one (or all) of the support fixtures 26. Each support fixture is rigidly and firmly supported in a T cross-sectioned groove 31 in panel 10. The decorative covering 50 conceals the support fixtures 26 and mounting screws 40, thereby providing an attractive ornamental display surface for any articles supported on brackets 28.

Figure 6:
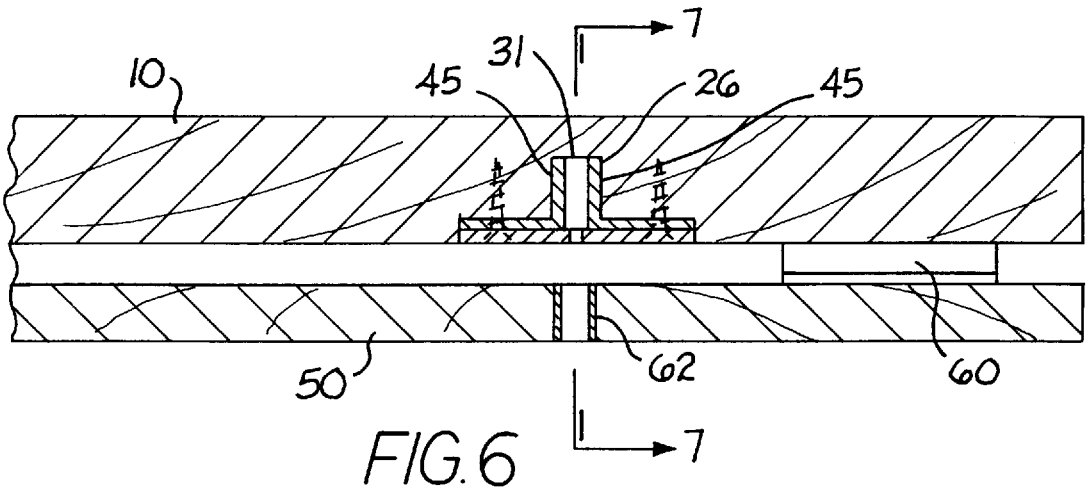
FIG. 6 is a fragmentary sectional view taken in the same direction as FIG. 3, but showing another embodiment of the invention.
Figure 8:
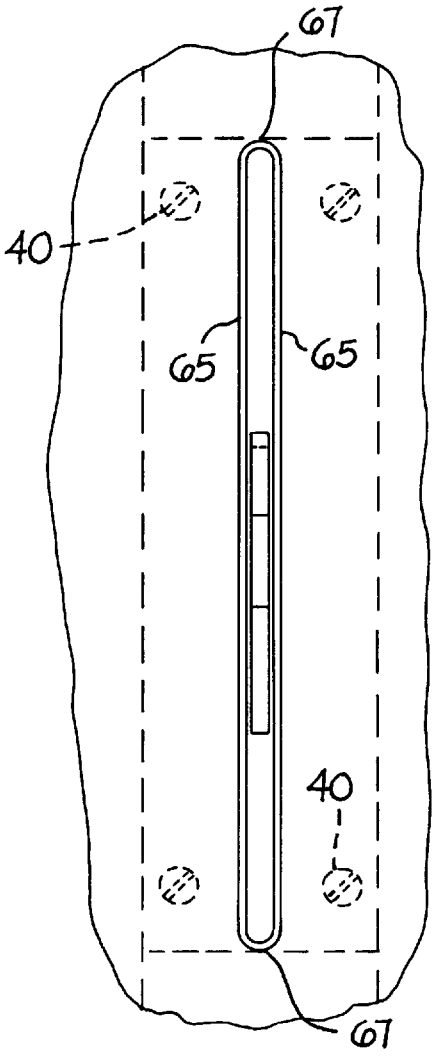
FIG. 8 is a front view of the FIG. 7 structure taken in the direction of arrow 8.
Figure 7:
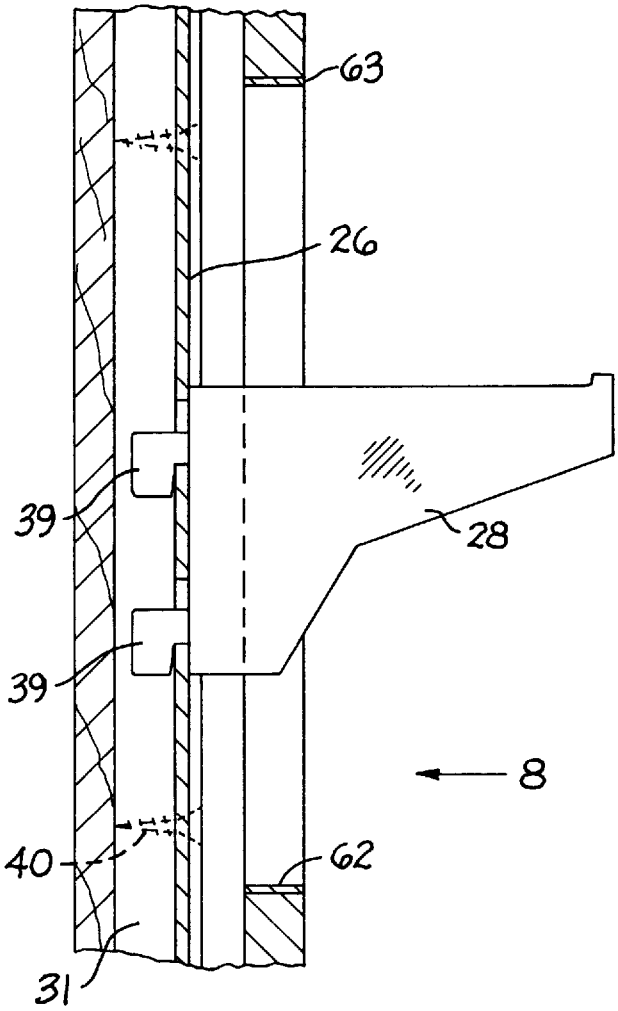
FIG. 7 is a fragmentary sectional view taken on line 7—7 in FIG. 6.

FIGS. 6, 7 and 8 illustrate a second form that the invention can take. The support panel 10 in this second embodiment of the invention can be constructed similarly to panel 10 in FIG. 1. Also, the individual fixtures 26 can be similar to the fixtures used in the FIG. 1 embodiment. However, the fixtures are mounted differently on panel 10. As shown in FIG. 6, a representative fixture 26 is mounted so that the parallel legs 45,45 of the fixture extend within the narrow groove portion 31 of the associated T cross-sectioned groove.

The decorative panel 50 is spaced forwardly from support panel 10 by means of interfitting hooks 60 on the two panels. Each set of hooks can be constructed similarly to hooks 18 and 20 (FIG. 2), whereby the decorative panel 50 can be removed and replaced whenever it is desired to change the decor of the display. Preferably, there are four sets of support hooks 60 for each panel 50, one set near each corner of the panel.

Within the broader scope of the invention, decorative panel 50 can be positioned flush against the front surface of support panel 10, in which case the decorative panel can be supported by screws.

Decorative panel 50 has a number of vertical metal rings 62 embedded in the panel material so that one edge of each ring 62 is flush with the front surface of the panel, as shown at 63 in FIG. 7. Each ring 62 is located in a slot-like perforation in panel 50 (formed e.g. by a milling operation). Each metal ring 62 comprises two parallel walls 65 and two semi-circular end walls 67 at the upper and lower ends of walls 65. Walls 65,65 are spaced apart the same distance as the thickness dimension of each article support bracket 28, so that when the bracket is in the FIG. 8 position, walls 65,65 will reinforce the bracket against lateral play or dislocation.

Rings 62 are spaced apart on panel 50 the same distance as support fixtures 26, such that one ring is aligned with each fixture 26. Rings 62 conceal the support fixtures and give the decorative panel 50 a smooth finished appearance. Panel 50 thus provides an attractive display surface behind support brackets 28.

The drawings show particular embodiments of the invention. However, it will be appreciated that the invention can be practiced in various forms and configurations.

Having described my invention, I claim:

1. An article display system comprising:

an upright unitary support panel having a front face and a rear face;

a plurality of vertical grooves in the panel front face;

a vertical plate (42) seated in each said groove, each said plate extending substantially the full length of an associated groove; plural sets of slots (47) located at vertically-spaced points along each plate;

an ornamental panel (50) located in front of said support panel; said ornamental panel having slot-type perforations therein registering with each set of slots in each vertical plate, and an annular ring in each perforation; and plural article-support brackets adapted for selective engagement with each set of slots; each said ring having facing surfaces that stabilize an associated bracket against lateral movement.

2. The display system of claim 1, wherein each said vertical groove has a T cross-section; each groove having a relatively wide shallow section in the panel front face and a relatively narrow deep section extending rearwardly from said shallow section; each said vertical plate being seated in the shallow section of the associated vertical groove.

3. An article display system comprising:

an upright unitary support panel having a front face and a rear face;

a plurality of vertical grooves in the panel front face;

a vertical plate seated in each said groove, each said plate extending substantially the full length of an associated groove; plural sets of slots (47) located at vertically-spaced points along each plate;

a separate ornamental panel (50) located in front of said support panel; said ornamental panel having slot-type perforations therein registering with each set of slots in each vertical plate, and bracket stabilization means proximate each perforation; and plural article-support brackets adapted for selective engagement with each set of slots; each said bracket stabilization means having facing surfaces that stabilize an associated bracket against lateral movement.

4. The display system of claim 3 wherein each said vertical groove has a T cross-section; each groove having a relatively wide shallow section in the panel front face and a relatively narrow deep section extending rearwardly from said shallow section; each said vertical plate being seated in the shallow section of the associated vertical groove.

5. The display system of claim 3, wherein each bracket stabilization means comprises a channel means extending forwardly from an associated vertical plate through an associated perforation in said ornamental panel.

6. The display system of claim 5, and further comprising an ornamental cap means on each channel means to conceal the joint between said channel means and the edge of the associated perforation.

7. The display system of claim 6, wherein each said cap means has a peripheral bead running along the peripheral joint between the associated channel means and perforation to conceal said joint.

8. The display system of claim 7, wherein each said cap means has a slot-like opening permitting an article-support bracket to be mounted on an associated channel means without removal of the cap means.

9. The display system of claim 3, wherein each bracket stabilization means comprises a channel means extending forwardly from an associated vertical plate through an associated perforation in said ornamental panel; each said channel means comprising a pair of angle members secured to an associated vertical plate; each angle member having a first leg secured to the vertical plate, and a second leg extending forwardly from said plate;

the combined thickness of each said vertical plate and the first leg of each angle member being equivalent to the depth of the associated groove, whereby the front faces of said first legs are flush with the front face of the support panel.

10. The display system of claim 3, wherein each bracket stabilization means comprises an annular ring located in an associated perforation in the ornamental panel.

11. The display system of claim 3, wherein each article-support bracket has two vertically spaced mounting hooks adapted for selective positioning in each set of slots in each said vertical plate.

12. An article display system comprising:

an upright unitary support panel (10) having a front face and a rear face;

plural vertical metal plates (42) secured to the front face of said support panel at horizontally spaced locations along said panel; each metal plate extending substantially the full vertical dimension of said panel;

plural sets of slots (47) located at vertically-spaced points along each said metal plate;

a separate ornamental panel (50) located in front of said support panel; said ornamental panel having slot-type perforations therein registering with each set of slots in each said metal plate;

plural article-support brackets adapted for selective support on each set of slots; each said bracket having two vertically-spaced mounting hooks adapted for selective positioning in each set of slots in each said vertical plate;

each said perforation having facing walls that engage side surfaces of an associated bracket for stabilizing said bracket against lateral movement;

said ornamental panel being removably disposed on said support panel, whereby said ornamental panel can be replaced with another ornamental panel having a different appearance.

* * * * *

UNITED STATES PATENT AND TRADEMARK OFFICE

CERTIFICATE OF CORRECTION

PATENT NO. : 5,803,274
DATED : September 8, 1998
INVENTOR(S) : Saul Scheveloff

It is certified that error appears in the above-identified patent and that said Letters Patent is hereby corrected as shown below:

In column 2, line 6, delete "show g", insert thereinstead --- showing ---.

Signed and Sealed this

Sixth Day of April, 1999

*Attest:*

*Attesting Officer*

Q. TODD DICKINSON

*Acting Commissioner of Patents and Trademarks*